United States Patent [19]

Pine et al.

[11] 4,149,965

[45] Apr. 17, 1979

[54] METHOD FOR STARTING-UP A NAPHTHA HYDROREFINING PROCESS

[75] Inventors: Lloyd A. Pine, Greenwell Springs; William E. Winter, Baton Rouge, both of La.

[73] Assignee: Exxon Research & Engineering Co., Florham Park, N.J.

[21] Appl. No.: 919,509

[22] Filed: Jun. 27, 1978

[51] Int. Cl.[2] ..... C10G 23/02

[52] U.S. Cl. ..... 208/216 R

[58] Field of Search ..... 208/216, 209, 211, 254 H, 208/144

[56] References Cited

U.S. PATENT DOCUMENTS

| | | | |
|---|---|---|---|
| 2,953,519 | 9/1960 | Bercik et al. | 208/216 |
| 3,109,804 | 11/1963 | Martin | 208/216 |
| 3,287,258 | 11/1966 | Mason | 208/254 H |
| 3,539,500 | 11/1970 | Brooks et al. | 208/144 |
| 3,953,321 | 4/1976 | Ganster et al. | 208/216 |

*Primary Examiner*—George Crasanakis

*Attorney, Agent, or Firm*—Marthe L. Gibbons

[57] ABSTRACT

A naphtha hydrorefining process is initiated by contacting an olefinic naphtha feed at hydrorefining conditions including a pressure below about 200 psig, with hydrogen and a catalyst that has been partially deactivated by treating a fresh or a regenerated catalyst with a substantially non-metals containing hydrocarbonaceous oil in the presence of hydrogen under conditions sufficient to decrease the hydrogenation activity of the catalyst.

18 Claims, No Drawings

METHOD FOR STARTING-UP A NAPHTHA HYDROREFINING PROCESS

BACKGROUND OF THE INVENTION

1. Field of the Invention

This invention relates to a startup method for an olefinic naphtha hydrorefining process.

2. Description of the Prior Art

Hydrorefining is a well known process for upgrading a variety of hydrocarbon fractions. Naphtha fractions are subjected to hydrorefining by treatment with hydrogen and a hydrofining catalyst to remove sulfur and nitrogenous compounds which may adversely affect the catalyst used in subsequent treating processes, such as, for example, reforming processes. When the naphtha fraction contains olefins, such as, for example, cracked naphthas or coker napthas, at least a portion of the olefins are hydrogenated to saturated hydrocarbons during the hydrorefining operation. Since the olefins are high octane components, for some end uses of the naphtha, it is desirable to retain the olefins rather than to convert them to saturated compounds. Conventional fresh hydrorefining catalyst have both hydrogenation and desulfurization activity. Typically, a fresh or a regenerated catalyst is used at the start of the hydrorefining process.

It is known to presulfide hydrorefining catalysts with a sulfur-containing hydrocarbonaceous oil such as a sulfur-containing naphtha prior to the hydrorefining step.

It is known to hydrodesulfurize a catalytically cracked naphtha under mild hydrodesulfurization conditions, including a pressure ranging from about 200 to 700 psig and in the presence of a partially spent catalyst to minimize hydrogenation of olefinic and aromatic constituents (see, for example, U.S. Pat. No. 2,983,669, column 6, lines 10–19).

It is also known to hydrodesulfurize an olefinic gasoline by adding a nitrogen compound to the feed in order to deactivate the catalyst for the hydrodesulfurization reaction (see, for example, U.S. Pat. No. 2,913,405).

It is known to hydrotreat a straight run fuel oil at a pressure not greater than 150 psig and at a temperature from 400° to below 500° F. in the presence of a catalyst that had been employed in a prior hydrotreating process operated at a higher pressure than the pressure of the fuel oil hydrotreating step until the catalyst had been substantially permanently deactivated for the purpose of said high pressure process, as shown in U.S. Pat. No. 3,870,626.

It has now been found that a hydrorefining process can be conducted with a minimal conversion of olefins to saturated hydrocarbons when a partially deactivated hydrorefining catalyst is used at the start of the run instead of utilizing fresh catalyst and that the pressure in the hydrorefining zone is maintained below about 200 psig.

SUMMARY OF THE INVENTION

In accordance with the invention there is provided, a method for starting-up a naphtha hydrorefining process which comprises: contacting naphtha comprising sulfur contaminants and at least 10 volume percent olefins with a hydrogen-containing gas and with a partially deactivated catalyst under hydrorefining conditions including a pressure ranging from about 60 psig to less than 200 psig, and at a temperature ranging from about 400° to about 800° F., said catalyst having been deactivated by contacting a fresh or a regenerated hydrorefining catalyst having hydrogenation and desulfurization activity with a substantially non-metals containing hydrocarbonaceous oil in the presence of a hydrogen-containing gas under conditions and for a time sufficient to decrease the hydrogenation activity of said fresh or regenerated catalyst.

DETAILED DESCRIPTION OF THE INVENTION

A fresh conventional hydrorefining catalyst having desulfurization and hydrogenation activity or a regenerated hydrorefining catalyst is contacted with a substantially non-metals-containing hydrocarbonaceous oil under conditions and for a time sufficient to decrease the hydrogenation activity of the fresh or regenerated catalyst and thereby produce a partially deactivated hydrorefining catalyst having decreased hydrogenation activity. The partial deactivation treatment should be such as to age the catalyst without substantially affecting its desulfurization selectivity.

The conditions for the partial deactivation of the catalyst are in part dependent on the properties of the oil used for the partial deactivation treatment. More olefinic or higher boiling oils used for the catalyst partial deactivation treatment will require a higher pressure catalyst partial deactivation treatment. Temperature and pressure requirements for activity maintenance as a function of feedstock properties are well known to those skilled in the art of hydrotreating. The conditions employed in the catalyst partial deactivation of the present invention must be such that loss of catalyst desulfurization activity is minimized. Furthermore, the conditions to be used for the catalyst partial deactivation treatment are also dependent upon the conditions to be used in the subsequent hydrorefining operation. For hydrofining processes at pressures below 150 psig, the catalyst partial deactivation treatment should be conducted at a pressure of at least 250 psig when an olefinic oil is used for the partial deactivation treatment. When a non-olefinic oil is used for the catalyst partial deactivation treatment, pressures lower than 250 psig may be used even though the subsequent hydrorefining process is conducted at a pressure below 150 psig.

Suitable conditions for the catalyst partial deactivation treatment include a temperature ranging from about 400° to 800° F., preferably 500° to about 600° F., a pressure ranging from about 150 to about 2000 psig, preferably a pressure ranging from about 250 to 400 psig, for a time ranging from about 10 hours to about 20 days with a hydrogen treat gas to liquid feed ratio of 600 scf/b to 3000 scf/b.

Suitable substantially non-metals containing hydrocarbonaceous oils include naphthas, vacuum gas oil, virgin gas oil, thermal and catalytic cycle oils. Suitable substantially non-metals containing feed contains less than 80 weight parts per million of total metals content, calculated as the metal, preferably less than 25 weight parts per million total metals, more preferably less than 5 weight parts per million total metals, most preferably less than 1 wppm total metals.

Suitable fresh catalyst include any of the conventional hydrorefining catalysts having hydrogenation and desulfurization activity. Generally, these catalyst comprise a hydrogenation component such as a metal, metal oxide or metal sulfide of a Group VIB and a non-noble metal of Group VIII of the Periodic Table of Elements on a suitable support, such as, for example, cobalt molybdate or nickel molybdate on a predominantly alumina support which may further comprise minor amounts of silica or other refractory oxides. The Periodic Table referred to herein is given in *Handbook of Chemistry and Physics* published by the Chemical Rubber Publishing Company, Cleveland, Ohio, 45th edition, 1964. Preferably the catalyst is cobalt-molybdenum on alumina catalyst.

After the fresh hydrorefining catalyst has been partially deactivated to the desired degree, it is contacted with a sulfur-containing olefinic naphtha in a hydrorefining zone under hydrorefining conditions to upgrade the naphtha. The term "naphtha" is used herein to refer to a mixture of hydrocarbons boiling (at atmospheric pressure) in the range of $C_5$ to about 430° F. The naphtha treated comprises at least 10 volume percent olefins, preferably at least 30 volume percent olefins, such as a naphtha produced by a catalytic cracking process (cracked naphtha), a naphtha produced by a coking process (coker naphtha), naphtha produced by a steam cracking process (steam cracked naphtha). Generally, such naphtha contains from about 0.01 to 1.0 weight percent sulfur. The preferred cracked naphtha is a light naphtha fraction boiling, at atmoshperic pressure, in the range of about $C_5$ to about 330° F. and comprising about 0.03 to 0.1 weight percent non-mercaptan sulfur contaminants.

Suitable hydrorefining conditions include a temperature ranging from about 400° to about 800° F., a pressure ranging from about 60 to less than 200 psig, preferably a pressure not greater than about 195 psig, a space velocity of from about 0.2 to 20 volumes of naphtha per hour per volume of catalyst, a hydrogen gas rate of 200 to 4000 standard cubic feet of hydrogen per barrel of naphtha. When the hydrorefining pressure ranges from about 60 to about 100 psig, it is preferred to partially deactivate the catalyst at a pressure ranging from about 250 to about 400 psig. When the hydrorefining pressure ranges from about 60 to about 100 psig, and when an olefinic oil is used for the catalyst partial deactivation treatment, then a pressure of at least 250 psig should be used in the catalyst partial deactivation treatment. The hydrorefining catalyst may be maintained in the hydrorefining zone in a fixed bed, moving bed, fluid bed, or ebullating bed.

The hydrorefining process of the present invention can be conducted in such a way that the recovered hydrorefined naphtha comprises not more than 100 wppm sulfur, preferably not more than 30 wppm sulfur with less than 15% of olefin saturation relative to the olefins present in the hydrorefining feed.

PREFERRED EMBODIMENTS

The following example is presented to illustrate the invention.

EXAMPLE

Experiments were conducted in which the catalyst was partially deactivated at various conditions and subsequently used for hydrotreating at various conditions. An intermediate boiling naphtha obtained from a catalytic cracking operation was used for the catalyst break-in period and subsequent hydrotreating operations. The properties of this naphtha fraction are listed in Table I. The conditions used for the catalyst break in and the subsequent hydrotreating conditions as well as the hydrodesulfurization and hydrogenation activities which remained after 30 days of hydrotreating the chargestock at the stated conditions are summarized in Table II.

TABLE I

FEED PROPERTIES
200/330° F. Cat Naphtha Fraction

| | |
|---|---|
| Gravity | |
| Sulfur, wppm | 613 wppm |
| Bromine No., cg/gm | 45.7 wppm |
| FIA, Vol.% | |
| Saturates | 36.1 |
| Unsaturates | 28.1 |
| Aromatics | 35.8 |
| Distillation, ASTM D-86, Vol., %, ° F. | |
| IBP/5% | 149/243 |
| 10/20 | 246/252 |
| 30/40 | 256/262 |
| 50/60 | 269/276 |
| 70/80 | 285/295 |
| 90/95 | 308/318 |
| FBP | 367 |
| RON | 90.5 |
| MON | 79.4 |

TABLE II

| Experiments | Catalyst Partial Deactivation Conditions | Subsequent Hydrotreating Conditions | Selectivity Factor Day 1 | Selectivity Factor Day 30 | Fraction HDS Activity Remaining after 30 Days at Conditions[1] |
|---|---|---|---|---|---|
| 1 | 5 Days, 150 psig, 530° F., 800 SCF/B $H_2$ | 180 psig, 550° F., 800 SCF/B $H_2$ | 0.53 | 0.64 | 1.0 |
| 2 | 5 Days, 150 psig, 530° F., 800 SCF/B $H_2$ | 90 psig, 550° F., 800 SCF/B $H_2$ | 0.71 | 0.66 | 0.5 |
| 3 | 4 Days at 400 psig, 3 Days at 250 psig, 550° F., 800 SCF/B | 180 psig, 550° F., 800 SCF/B | 0.52 | 0.62 | 1.0 (at 20 days) |
| 4 | 4 Days at 400 psig, 550° F., 800 SCF/B $H_2$ 3 Days at 250 psig, 550° F., 800 SCF/B $H_2$ 2 Days at 180 psig, 550° F., 800 SCF/B $H_2$ 1 Day at 90–100 psig, | 80 psig, 530° F., 2000 SCF/B | 0.68 | 1.01 | 1.0 |
| 5 | 10 Days at 150 psig, 530° F., 800 SCF/B | 80 psig, 530° F., 2000–3000 SCF/B | 0.68 | 0.61 | 0.8 (at 5 days) |

[1]Activity relative to activity at day 1 after break-in.

The catalyst used in these experiments was a commercially available cobalt molybdate on alumina catalyst ($CoMo/Al_2O_3$) that had been partially deactivated by being treated at the conditions given in Table II. Prior to the partial deactivation treatment (i.e. catalyst-break-in), the catalyst was calcined and presulfided in a conventional way using a blend of 10 volume percent hydrogen sulfide in hydrogen. As can be seen from Table II, experiment 1 conducting catalyst break-in at 150 psig, 530° F., 800 SCF/B hydrogen was suitable for subsequent hydrotreating conducted at 180 psig, 550° F. and 800 SCF/B. Since the break-in period resulted in good hydrodesulfurization maintenance, the desulfurization versus hydrogenation selectivity improved during subsequent operations lining out at a value of selectivity factor of 0.64, where the selectivity factor is proportional to the ratio of desulfurization and hydrogenation rate constants. The selectivity factor (S.F.) referred to herein can be represented by the following equation:

$$\text{selectivity factor} = \frac{\frac{1}{\sqrt[3]{S_p}} - \frac{1}{\sqrt[3]{S_f}}}{\ln \frac{Br_f}{Br_p}}$$

where $S_f$, $S_p$ are feed and product sulfur level, respectively and $Br_f$, $Br_p$ are feed and product bromine number, respectively. Experiment 3 showed that conducting break-in at 250 to 400 psig is preferable to a lower pressure breakin (experiment 1) since desulfurization activity on completion of the breakin period was higher for experiment 3 than for experiment 1. As shown in experiments 2 and 5, initial catalyst desulfurization selectivity at 90 psig, 550° F., 800 SCF/B was higher than at 180 psig after the low pressure break-in. Lined out desulfurization selectivity was no better in experiments 2 than 3. Since desulfurization activity was substantially less, there was no advantage to the lower pressure operations. However, by conducting higher pressure break-in (experiment 4) initial catalyst selectivity was better for 80 psig hydrotreating than for 180 psig and lined out catalyst selectivity was twice that at 180 psig hydrotreating following either high or low pressure break-in.

As will be obvious to those skilled in the art, modifications may be made to the above described apparatus without departing from the concept of the invention, which accordingly is defined by the following claims.

What is claimed is:

1. A method for starting up a naphtha hydrorefining process for removing sulfur contaminants from said naphtha, which comprises: contacting naphtha containing said sulfur contaminants and at least 10 volume percent olefins with a hydrogen-containing gas and with a partially deactivated catalyst under hydrorefining conditions including a pressure ranging from about 60 psig to less than 200 psig, and at a temperature ranging from about 400° to about 800° F., said catalyst having been deactivated by contacting a fresh or a regenerated hydrorefining catalyst having hydrogenation and desulfurization activity with a substantially non-metals containing hydrocarbonaceous oil in the presence of a hydrogen-containing gas under conditions and for a time sufficient to decrease the hydrogenation activity of said fresh or regenerated catalyst.

2. The method of claim 1 wherein said hydrorefining conditions include a pressure of not more than about 195 psig.

3. The method of claim 1 wherein said conditions for partially deactivating said catalyst comprise a pressure ranging from about 150 to about 2000 psig and a temperature ranging from about 400° to about 800° F.

4. The method of claim 1 wherein said conditions for partially deactivating said catalyst comprise a pressure of at least about 250 psig.

5. The method of claim 1 wherein said conditions for partially deactivating said catalyst comprise a pressure ranging from about 250 to about 400 psig.

6. The method of claim 1 wherein said hydrorefining conditions include a pressure ranging from about 60 to about 100 psig and wherein said partial deactivation conditions comprise a pressure ranging from about 250 to about 400 psig.

7. The method of claim 1 wherein said naphtha comprises at least 30 volume percent olefins.

8. The method of claim 1 wherein said naphtha is selected from the group consisting of cracked naphtha, coker naphtha and steam cracked naphtha.

9. The method of claim 8 wherein said cracked naphtha is a fraction having an atmospheric boiling point ranging from about $C_5$ to about 330° F.

10. The method of claim 1 wherein said substantially non-metals containing hydrocarbonaceous oil comprises less than about 80 weight parts per million total metals, calculated as the metal.

11. The method of claim 1 wherein said substantially non-metals containing hydrocarbonaceous oil comprises less than about 25 weight parts per million total metals, calculated as the metal.

12. The method of claim 1 wherein said substantially non-metals containing hydrocarbonaceous oil is selected from the group consisting of naphtha, vacuum gas oils, virgin gas oils, thermal and catalytic cycle oils.

13. The method of claim 1 wherein said fresh or regenerated catalyst comprises at least one Group VIB and one Group VIII non-noble metal component composited with a support.

14. The method of claim 1 wherein said catalyst comprises a metal, metal oxide and metal sulfide of a Group VIB and of a non-noble metal of a Group VIII on a support.

15. The method of claim 14 wherein said support is alumina.

16. The method of claim 15 wherein said alumina additionally comprises a minor amount of silica.

17. A method for starting up a naphtha hydrorefining process for removing sulfur from said naphtha, which comprises:

(a) contacting a fresh or regenerated hydrorefining catalyst with a substantially non-metals containing naphtha, said naphtha comprising at least 10 volume percent olefins, and with a hydrogen-containing gas, at a pressure ranging from about 250 to about 400 psig and at a temperature ranging from about 400° to about 800° F. for a time sufficient to decrease the hydrogenation activity of said catalyst, and (b) contacting the resulting partially deactivated catalyst with a hydrogen-containing gas and with a naphtha feed comprising at least 10 volume percent olefins, at hydrorefining conditions, including a pressure of not more than about 195 psig and a temperature ranging from about 400° to about 800° F., and (c) recovering a hydrorefined naphtha comprising less than 100 weight ppm sulfur.

18. The method of claim 17 wherein the recovered hydrorefined naphtha comprises 85 volume percent of olefins relative to the initial olefins in the feed.

* * * * *